United States Patent [19]

Hull et al.

[11] Patent Number: 4,896,392

[45] Date of Patent: Jan. 30, 1990

[54] CLEANING DEVICE

[76] Inventors: Harold L. Hull, 401 Canyon Way, Sp. 43, Sparks, Nev. 89431; Charles Partee, P.O. Box 331, Janesville, Calif. 96114

[21] Appl. No.: 173,866

[22] Filed: Mar. 28, 1988

[51] Int. Cl.[4] ..... E04H 3/20; F04F 10/00

[52] U.S. Cl. ..... 15/1.7

[58] Field of Search ..... 15/1.7, 344; 422/100; 210/169

[56] References Cited

U.S. PATENT DOCUMENTS

| | | | |
|---|---|---|---|
| 1,204,368 | 11/1916 | Lowy | 422/100 |
| 2,376,231 | 5/1945 | Cohn | 422/100 |
| 2,540,364 | 2/1951 | Adams | 422/100 |
| 3,258,801 | 7/1966 | Campbell | 15/1.7 |

*Primary Examiner*—Edward L. Roberts

[57] ABSTRACT

A cleaning device for removal of sand and/or debris from the bottom of a tank. The device comprises a cylinder having an opening at a first end which is smaller than the cylinder. A handle is mounted on a second end of the cylinder. A vent opening is formed in the cylinder adjacent the handle. A valve is mounted on the handle to open and close the opening.

7 Claims, 1 Drawing Sheet

CLEANING DEVICE

BACKGROUND OF THE INVENTION

This invention relates to a cleaning device and more particularly to a device for removal of sand and/or debris that has settled to the bottom of a tank or a tub such as a hot tub or a body of water such as a lake or river bed. This devise might be considered a sand pump, a vacuum pump, a suction pump or the like.

Prior art shows a number of ways to accomplish this objective such as electrical pumps, motor driven pumps, air evacuation systems, pistons, screw mechanisms, etc, with all of them involving moving parts and a power source of some nature. Patent Nos. 3,199,678; 3,158,104; and 3,549,015 shows various systems.

SUMMARY OF THE INVENTION

A primary object of this invention is to provide a simple tool to remove the sand and debris from the bottom of a container such as a hot tub or spa, said means having no or few moving parts.

a further object is to provide a tool to remove sand and debris from the bottom of a container such as a hot tub or spa without the use of a tool using electricity which can be fatal to the user.

A further object is to provide a tool to remove sand and debris from the bottom of a container such as a hot tub or spa while immediately returning any hot water used in the removal process.

A further object is to provide a tool that a child can use to remove sand and debris from a swimming pool such as a child's back yard pool which collects grass, sand and the like from the children's feet and the like and is difficult to remove without dumping the entire pool which is a cumbersome job which a child has difficulty in accomplishing.

It is a further purpose to provide a tool which may be used in gold mining or prospecting for removing sand from crevices around rocks or hard to reach places in a stream, river bed, or the like.

It is a further purpose to provide a light weight tool that has no power source and no moving parts that can be carried by a prospector for use in gold mining for removing sand from crevices, around rocks or hard to reach places in a steam, river bed, or lake bed, or the like.

It is a further purpose to provide a tool for the removal of sand or debris from a body of water, which is telescopic so that it can be extended at will thus making it more efficient at deeper depths and also collapsible for ease of carrying.

BRIEF DESCRIPTION OF THE DRAWINGS

FIG. I is a side view of the first form of the invention.

FIG. II is a side view of the second form of the invention.

FIG. III is a side view of the third form of the invention.

Figure 1:
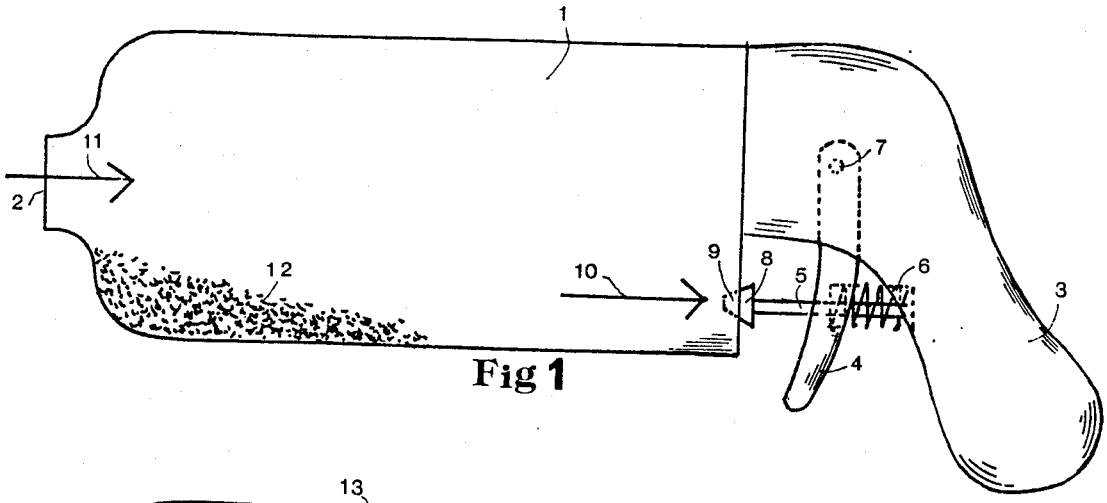
Figure 2:
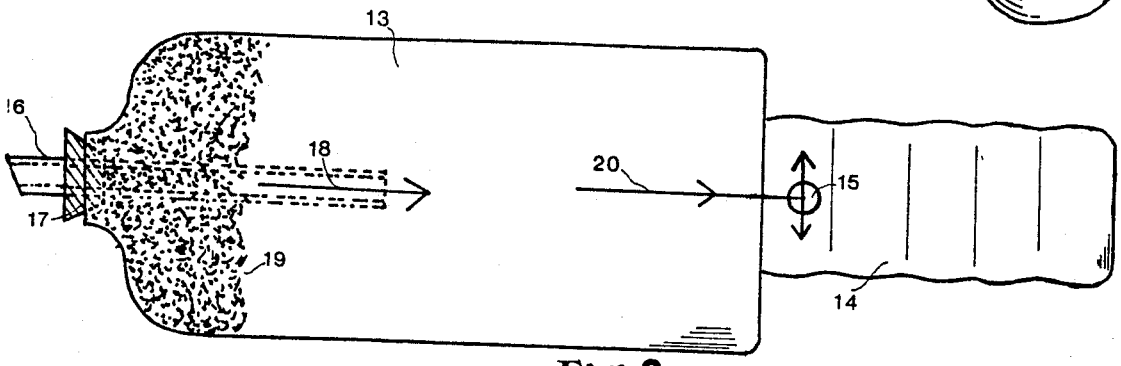
Figure 3:
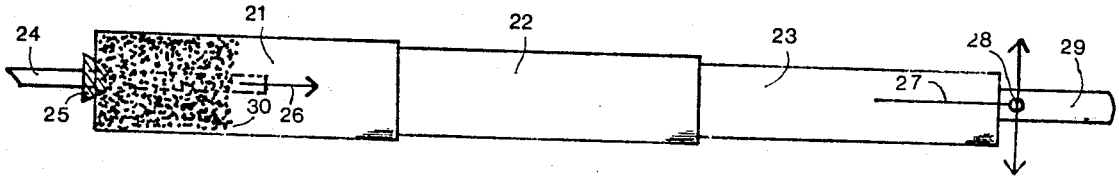

REFERRING IN GREATER DETAIL TO THE DRAWINGS:

FIG. 1 shows a water and/or airtight elongated container 1 with an opening at one end 2 and a handle 3 at the opposite end, while 4 is a trigger, pivoted at 7 with 8 being a stopper or valve, and 9 being the valve seat in container 1, while 5 is a shaft connected to stopper 8 at one end, which is held against valve seat 9 by spring 6, while 10 is an arrow that shows the direction of escaping air when trigger 4 is pulled and container 1 is immersed in water, while 11 shows the direction of the intake of water and sand, while 12 is sand and debris that has been taken into container and has settled.

It will be seen by the first form of the invention as shown in FIG. 1, that when the handle 3 is grasped and the container 1 is immersed in water such as in a hot tub or spa or the like, that by placing opening 2 against or near the sand or debris that is to be removed and then pulling trigger 4 that the water around the container will rush forcefully into the container in the direction of arrow 11 through opening 2, bringing the sand or debris 12 with it and forcing the air in the container 1 out of the valve opening 9. When the container fills with water and is removed from the hot tub or spa or the like, the sand and/or debris 12 settles to the side of container as shown. and now the water may returned to the hot tub or spa or the like by opening valve 9 leaving the sand or debris 12 in the container 1 which can now be emptied of the sand or debris 12.

FIG. II shows the second form of the invention with 13 being a water and/or air tight elongated container, with handle 14, air escape hole 15, cork or stopper 17, and passageway such as a tube or pipe 16 passing through cork or stopper 17 and entering container 1.

It will be seen by the second form of the invention as shown in FIG. 11 that when the handle 14 is grasped and air escape hole 15 is covered by a thumb or finger and the container 1 is immersed in water such as in a hot tub or spa or the like that by placing the open end of passageway or tube or pipe 16 against or near the sand or debris that is to be removed and then releasing the thumb or finger from air escape hole 15 that the water around the container will rush forcefully through passageway or tube or pipe 16 into container 13, bringing the sand or debris 19 with it and forcing the air in the container 13 out through air escape hole 15 as shown by arrow 20. It will be seen that when container is full of water and air escape hole 15 is again covered by a thumb or finger and container is removed from the hot tub or spa or the like that the sand or debris 19 will settle in one end of the container 13 when container 1 is held with handle 14 in and up right position. Now passageway or tube or pipe 16 being slideable in cork 17 may be pulled out until the inside end of tube or pipe 16 reaches just above the sand or debris 19 level and when the thumb or finger is removed from air escape hole 15 the water in container 13 may be returned to the hot tub or spa or the like. After the water has been emptied from container 13, the cork 17 with passageway or tube or pipe 16 may be removed from container 13 and the sand or debris 19 emptied.

FIG. 111 shows a third form of the invention in which the water and/or air tight container is made up of telescopic sections 21,22, and 23, handle 29, air escape hole 28, cork or stopper 25, and a passageway or tube or pipe 24 passing through cork or stopper 25 and entering first telescopic section 21.

This third form of the invention as shown in FIG. 111 performs in a like manner as the second form of the invention as shown in FIG. 11, however because of its telescopic feature it may be made to reach deeper into a body of water such as a creek bed or river bottom or the like and retrieve sand from around rock or crevices or the like which is the natural settling place for gold nuggets and free gold. Also being collapsible makes it easier for the prospector to carry.

Although the invention has been herein shown and described in what is conceived to be the most practical and preferred embodiments, it is recognized that departures may be made therefrom within the scope of the invention which is not to be limited to the details disclosed herein but is to be accorded the full scope of the claims so as to embrace any and all equivalent devices and apparatus.

Having described our invention, what we claim as new and desire to secure by Letters Patent is:

1. A cleaning device comprising a cylinder with an opening at a first end, said opening being substantially smaller than said cylinder, a debris retaining chamber in said cylinder, a handle mounted at a second end of said cylinder, a vent opening in said cylinder adjacent said handle, a valve means mounted on said handle positioned to open and close said vent opening, and means on said handle to move said valve means, to open and close said vent opening.

2. The device of claim 1 in which the said opening at a first end of said cylinder is a tube smaller than said cylinder, extending outwardly from a first wall of said cylinder and being a part of and cooperating with said cylinder.

3. The device of claim 1 in which the said debris retaining chamber slopes sharply away from said opening at said first end in substantially a ninety degree angle.

4. The device of claim 1 in which said handle mounted at said second end of said cylinder is a pistol grip.

5. The device of claim 1 in which said means to open and close said valve means is a trigger and a return spring.

6. A cleaning device comprising a cylinder with an opening at a first end, said opening being smaller than said cylinder, a debris retaining chamber in said cylinder, means to removably mount a tube in said opening, said tube extending from the outside of said opening into the interior of said chamber, a handle means mounted at a second end of said cylinder, an opening in said handle, said opening in said handle leading into said debris retaining chamber, whereby said opening in said handle is closeable by a thumb or finger.

7. The device of claim 6 in which said means to removably mount said tube is a cork.

* * * * *